US005814926A

United States Patent [19]

Tomihari

[11] Patent Number: 5,814,926

[45] Date of Patent: Sep. 29, 1998

[54] ELECTRON EMISSION DEVICE WITH OFFSET CONTROL ELECTRODE

[75] Inventor: Yoshinori Tomihari, Shiga, Japan

[73] Assignee: NEC Corporation, Tokyo, Japan

[21] Appl. No.: 547,879

[22] Filed: Oct. 25, 1995

[30] Foreign Application Priority Data

Oct. 28, 1994 [JP] Japan ..... 6-265044

[51] Int. Cl.[6] ..... H01J 1/30

[52] U.S. Cl. ..... 313/309; 313/336; 313/351; 313/495

[58] Field of Search ..... 313/309, 336, 313/351, 495, 412, 413, 414

[56] References Cited

U.S. PATENT DOCUMENTS 5,559,389 9/1996 Spindt et al. ..... 313/336

FOREIGN PATENT DOCUMENTS 4-292831 10/1992 Japan .

6-12974 1/1994 Japan .

*Primary Examiner*—Sandra L. O'Shea

*Assistant Examiner*—Vip Patel

*Attorney, Agent, or Firm*—Young & Thompson

[57] ABSTRACT

An electron emission device which allows provision of a larger-current, sharper, higher-resolution beam of electrons, has a offset control electrode 10 which is located, on an insulating layer 9, above a gate electrode 7 formed on a plurality of cathodes 4. Each of the centers of the openings of the control electrode 10 is offset from the centers of the openings of the gate electrode 7.

5 Claims, 2 Drawing Sheets

ELECTRON EMISSION DEVICE WITH OFFSET CONTROL ELECTRODE

BACKGROUND OF THE INVENTION

1. Field of the Invention

The present invention relates to a field-emission type electron source, and particularly to a miniature-size electron emission device for use in field-emission cathode-ray tubes, which may be used as an electron gun for planar displays.

2. Description of the Prior Art

Electron guns employed in planar cathode-ray tubes include an electron emission device which comprises a planar array of a lot of miniature-size cathodes, as disclosed in Japanese Unexamined Patent Application (KOKAI) No. 4-292831. As shown in FIG. 4, this type of electron emission device has an insulative substrate 1 on which an electrode 2 with a circular opening 2*a* is provided. The entire top surface of the electrode 2 is coated with a resistive layer 3. In addition, a total of nine conical cathodes 4 are formed on resistive layer 3 at the center of the opening 2*a* of the electrode 2 and at locations surrounding the center. In addition, an insulating layer 6 with cavities 5 surrounding the cathodes 4 is formed over the substrate 1. The structure is further provided with a gate electrode 7 placed on the insulating layer 6 as an electrode opposed to the cathodes 4.

The electron emission device constructed in this way is capable of emitting electrons without heating the cathodes 4 by placing a voltage (a few volts) between the gate electrode 7 and the cathodes 4 which produces a field strength of approximately $10^7$ V/cm or more.

The configuration shown in FIG. 4 presents a problem, however, in that the electrons emitted by the cathodes have angles of divergence, and therefore the electron beams extend outward, increasing their sizes and further decreasing the directivity of the electron beams.

As a solution to overcome this problem, Japanese Unexamined Patent Application (KOKAI) No. 6-12974 discloses a technique for forming a diverging electrode or control electrode 8 on the gate electrode 7 via an insulating layer 9 to converge beams of emitted electrons toward the center through the use of an electric field created by the converging electrode 8 as is shown in FIG. 5.

In cases where the above-mentioned electron emission device is used as the electron gun for a cathode-ray tube, however, each cathode 4 emits only a very small number of electrons whose directivity cannot be satisfactorily maintained if divergence of the electrons is attempted to be prevented only with the converging electrode 8. In view of this defect, it has been suggested to converge and utilize a lot of electron beams emitted from a lot of cathodes 4 with a separately provided electron lens. However, this method also presents a problem in that since the direction of electron beams cannot be controlled, it is rather difficult to establish matching between the electron emission device and the electron lens, etc., thus resulting in lower resolution, a greater number of steps for matching, etc.

SUMMARY OF THE INVENTION

In order to overcome the above-mentioned problems, it is an object of the present invention to provide an electron emission device which allows improvement in directivity of electron beams emitted by a plurality of cathodes with a control electrode formed integrally with the electron emission device, thereby providing a large-current, sharp, high-resolution electron beam.

The electron emission device according to the present invention is characterized in that each of the centers of openings of a control electrode except for a central opening thereof is offset from the respective centers of cathodes and from the centers of openings of the gate electrode except for a central region.

Further, it is desired that the cathodes are placed, for example, at the center of the substrate and at locations along a concentric circle around the center. A central opening center of the openings of the control electrode is located right over a center cathode and peripheral openings are offset by given amounts inward or outward in radial directions with respect to the cathodes arranged along the concentric circle. The given amounts of offset may change in the direction from the inner to outer cathodes.

With the above-described configuration, since the electron beams emitted by the respective cathodes are converged toward the centers of the openings of the control electrode by the control electrode while being deflected in proportion to the amount of offset between the centers of the openings of the control electrode and the gate electrode, the electron beams emitted by all the cathodes may be converged into a single electron beam by, for example, locating the centers of the openings of the control electrode right above the cathode at the center and inward with respect to the cathodes along the concentric circle(s).

In addition, in cases where the centers of the openings of the control electrode are located right above the cathode at the center and outward with respect to the cathodes along the concentric circle(s) and a large-diameter lens is used for convergence of the electron beams, since the directions of divergence of the electron beams may be controlled uniformly, the electron beams emitted by all the cathodes may be converged into a single electron beam with increased resolution.

Further, it is also possible to realize a larger-capacity electron emission device which allows convergence of increased numbers of electron beams, by placing cathodes at the center of the substrate and along a plurality of concentric circles around the center, with the centers of the openings of the control electrode offset by given amounts which gradually change in the direction from the inner to outer cathodes.

DETAILED DESCRIPTION OF THE PREFERRED EMBODIMENTS

Figure 1:
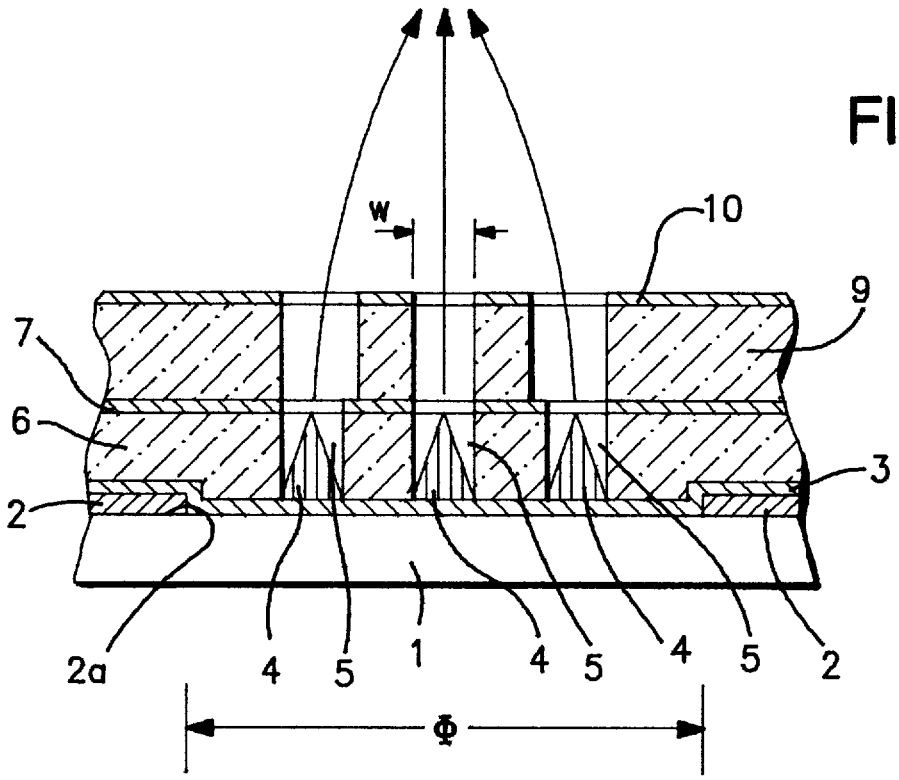
FIG. 1 is a sectional view of the main portions of an electron emission device according to the first embodiment of the present invention.

The present invention will now be explained with reference to the accompanying drawings. Parts corresponding to those of the prior art will be referred to by like reference characters and their explanation will be omitted.

As is shown in FIG. 1, the electron emission device according to the first embodiment of the present invention may be formed of an electrode 2 which may be composed of aluminum or the like and has a circular opening 2*a* with a diameter Φ in the order of 10 μm, coated on an insulative substrate 1 composed of glass or the like. The entire surface of the electrode 2, including the opening 2*a*, is coated with a resistive layer 3 which is composed of an approximately 0.5 μm-thick silicon thin film or the like with a resistivity of 3,000 Ω.cm. In addition, nine cathodes 4 composed of a high-melting, low-work-efficiency metal such as tungsten or molybdenum are formed, on the resistive layer 3, at the center of the opening 2*a* of the electrode 2 and at locations along a circle with a diameter of 6 μm which is concentric to the opening 2*a*. Each cathode 4 is shaped as a cone with a sharp top.

There is formed a first insulating layer 6 with circular cavities 5 measuring 1–1.5 μm in diameter (width of the opening, indicated by w in the drawing) which surround the respective cathodes 4. The structure is further provided with a gate electrode 7 composed of a high-melting metal such as molybdenum, tungsten or niobium which is placed on the insulating layer 6 as an electrode opposed to the cathodes 4. In addition, a control electrode 10 is formed above the gate electrode 7 on a second insulating layer 9. The first and second insulating layers 6 and 9 are both composed of silicon oxide or the like and each measure approximately 2 μm in thickness. The centers of the openings of the control electrode 10 are located right above the cathode 4 placed at the center of the insulating substrate 1, but offset toward the center by 0.2 μm with respect to cathodes 4 arranged along the concentric circle.

The electron emission device fabricated in this way emits electrons without heating the cathodes 4 by placing a voltage (a few volts) between the gate electrode 7 and the cathodes 4 which produces a field strength of approximately $10^7$ V/cm or more. As is indicated by the arrow shown in the drawing, electrons emitted by the cathode 4 placed at the center travel as a straight beam of electrons by the action of the control electrode 10. On the other hand, electrons emitted by the cathodes arranged along the concentric circle converge as electron beams deflecting toward the center. Therefore, provision of screens at the respective points of convergence of the electron beams allows convergence of beams of the electrons emitted by the nine cathodes or electron emission elements into a single, larger-current, sharp beam of electrons. Here, the voltage applied to the control electrode 10 is set to be smaller than that applied to the gate electrode 7, but larger than that applied to the cathodes 4.

Figure 2:
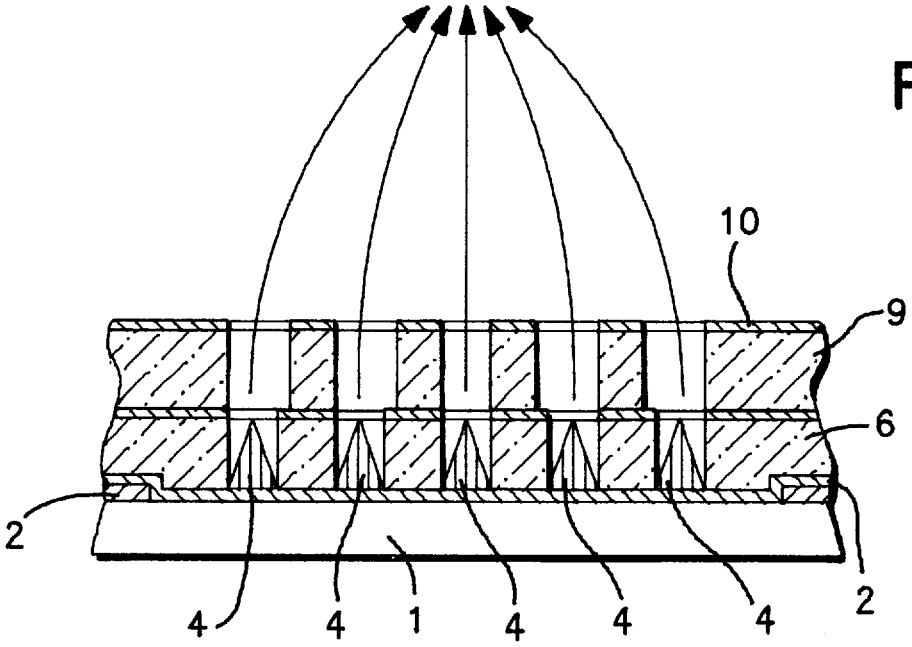
FIG. 2 is a sectional view of the main portions of an electron emission device according to the second embodiment of the present invention.

As shown in FIG. 2, an electron emission device according to the second embodiment of the present invention comprises, for example, one cathode 4 placed at the center of the insulation board 1 and eight and sixteen cathodes 4 arranged along two concentric circles with diameters of 6 and 12 μm, respectively. The control electrode 10 is located with the centers of its openings offset to the center by 0.2 μm with respect to the cathodes 4 arranged along the inner concentric circle and by 0.4 μm with respect to the cathodes 4 arranged along the outer concentric circle. This type of electron emission device may converge beams of electrons emitted by the twenty-five electron emission elements into a single, larger-current, sharper beam of electrons.

Figure 3:
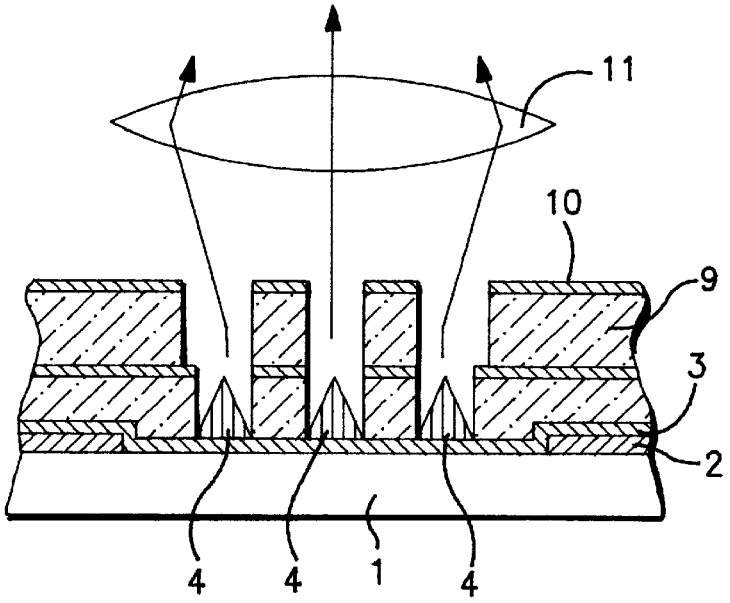
FIG. 3 is a sectional view of the main portions of an electron emission device according to the third embodiment of the present invention.
Figure 4:
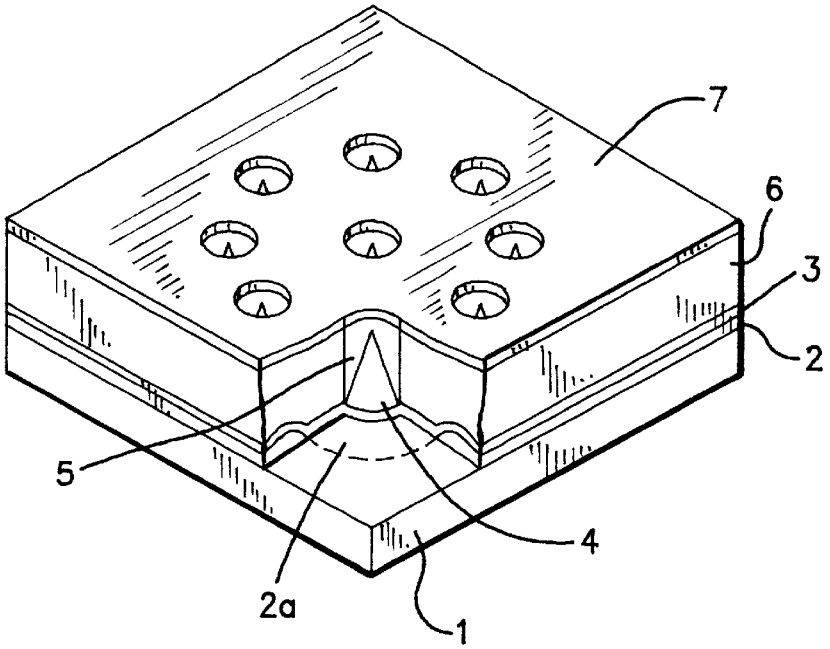
FIG. 4 PRIOR ART
FIG. 4 is a perspective view of the main portions of a prior art electron emission device.
Figure 5:
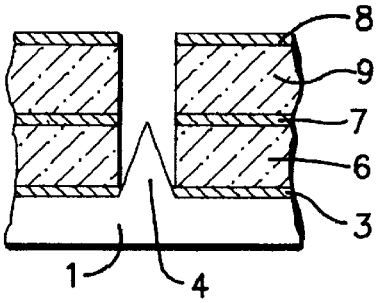
FIG. 5 PRIOR ART
FIG. 5 is a sectional view of the main portions of another prior art electron emission device.

As is shown in FIG. 3, an electron emission device according to the third embodiment of the present invention is composed of one cathode 4 placed at the center of the insulating substrate 1 and, for example, eight cathodes 4 arranged along a concentric circle with a diameter of 6 μm. The control electrode 10 is located with the centers of its openings offset outward in radial directions by 0.2 μm with respect to the cathodes 4 arranged along the concentric circle, and the beams are converged through a separately provided large-diameter lens 11. Since angles of incidence of the beams of electrons on the large-diameter lens 11 may be controlled with this type of electron emission device, a higher-resolution, larger-current beam of electrons may be produced.

The foregoing explanation concerns a case where an electrode is formed on a glass substrate, cathodes are placed on the electrode via a resistive layer, one cathode at the center and eight cathodes along a concentric circle around the center, or eight and sixteen cathodes along two concentric circles around the center, respectively, and a one-layer control electrode is formed; however, the present invention is not restricted to this case. For example, it is possible to form silicon cathodes directly on a silicon substrate without an intervening resistant layer, to place more cathodes along more numbers of concentric circles and to have multilayer control electrodes arranged in two or more layers for larger current and improved convergence characteristics.

According to the present invention, those cathodes to be arranged apart from the center of the substrate may be placed at any locations apart from the center in a random fashion, without being restricted to locations along the one or more concentric circles as in the foregoing embodiments.

In addition, as shown in the drawings, it is desired that the diameters of the second cavities and the apertures of the openings of the control electrode be larger than the diameters of the first cavities and the apertures of the openings of the gate electrode, respectively, preferably with inscribed relationships as shown between the cavities and between the electrodes for smoother emission of electron beams.

As is described above, with an electron emission device according to the present invention, beams of electrons emitted by the respective cathodes are converged by the deviated control electrode toward the center of the control electrode and further deflected in proportion to the amount of offset between the control electrode and the gate electrode. Therefore, beams of electrons emitted by all the cathodes may be converged into a single beam of electrons by locating the centers of the openings of the control electrode right above the cathode placed at the center of the substrate and inward with respect to those cathodes arranged along the concentric circles.

Accordingly, there is provided an electron emission device suitable for use in cathode-ray tubes, which allows provision of a larger-current, sharp, higher-resolution beam of electrons by efficiently converging beams of electrons emitted by a plurality of cathodes with a control electrode formed integrally with the electron emission device.

What is claimed is:

1. An electron emission device comprising:

a plurality of protruding cathodes formed on a substrate;

a first electrode placed above said cathodes on a first insulating layer; and a second electrode placed above said first electrode on a second insulating layer, centers of second openings of said second electrode being offset from centers of first openings of said first electrode.

2. The electron emission device as claimed in claim 1, wherein one of said cathodes is placed at a first position on the substrate and others of said cathodes are placed at locations surrounding said first position, and wherein the centers of said second openings are offset along radii extending from said first position toward the surrounding locations.

3. The electron emission device as claimed in claim 2, wherein said other cathodes are arranged concentrically, and wherein an amount of offset of the centers of said second openings varies along said radii.

4. The device of claim 1, wherein said centers of said second openings are offset toward a center of said plurality of cathodes.

5. The device of claim 1, wherein said centers of said second openings are offset away from a center of said plurality of cathodes.

* * * * *